US010047585B2

(12) United States Patent
Pickle

(10) Patent No.: US 10,047,585 B2
(45) Date of Patent: Aug. 14, 2018

(54) SEALING A DOWNHOLE TOOL

(71) Applicant: Halliburton Energy Services, Inc., Houston, TX (US)

(72) Inventor: Brad Richard Pickle, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 649 days.

(21) Appl. No.: 14/433,289

(22) PCT Filed: Oct. 5, 2012

(86) PCT No.: PCT/US2012/059041
§ 371 (c)(1),
(2) Date: Apr. 2, 2015

(87) PCT Pub. No.: WO2014/055087
PCT Pub. Date: Apr. 10, 2014

(65) Prior Publication Data
US 2015/0260004 A1 Sep. 17, 2015

(51) Int. Cl.
*E21B 33/12* (2006.01)
*E21B 33/04* (2006.01)
(Continued)

(52) U.S. Cl.
CPC ..... *E21B 33/12* (2013.01); *E21B 23/06* (2013.01); *E21B 33/04* (2013.01); *E21B 33/1208* (2013.01); *E21B 33/129* (2013.01)

(58) Field of Classification Search
CPC ..... E21B 33/12; E21B 33/04; E21B 33/1208; E21B 33/129; E21B 23/06
See application file for complete search history.

(56) References Cited

U.S. PATENT DOCUMENTS 2,331,532 A * 10/1943 Bassinger ..... E21B 33/129 166/124
2,698,056 A * 12/1954 Marshall ..... E21B 23/02 166/123

(Continued)

OTHER PUBLICATIONS

PCT International Search Report and Written Opinion of the International Searching Authority, PCT/US2012/059041, dated Mar. 28, 2013, 12 pages.

(Continued)

*Primary Examiner* — Matthew R Buck
*Assistant Examiner* — Aaron L Lembo
(74) *Attorney, Agent, or Firm* — Scott Richardson; Parker Justiss, P.C.

(57) ABSTRACT

Techniques for sealing an annulus between a well tool and a tubular include moving the well tool through a wellbore in a run-in position, the well tool including a seal and a sleeve carried on the mandrel, and covering, in the run-in position, an exterior surface of the seal opposite an interior surface of the seal that faces the mandrel; landing the well tool in a tubular that includes a shoulder on an inner surface of the tubular and a seal bore on the inner surface of the tubular, the sleeve adjacent the shoulder upon landing the well tool; and receiving a force that moves a portion of the well tool further downhole to expose at least a part of the seal to the inner surface of the tubular to create a seal between an exterior surface of the well tool and the inner surface of the tubular.

23 Claims, 4 Drawing Sheets

(51) Int. Cl.
*E21B 23/06* (2006.01)
*E21B 33/129* (2006.01)

(56) References Cited

U.S. PATENT DOCUMENTS

| | | | | |
|---|---|---|---|---|
| 3,411,584 | A | 11/1968 | Sizer et al. | |
| 3,907,307 | A * | 9/1975 | Maurer | F04B 53/164 277/513 |
| 4,224,987 | A | 9/1980 | Allen | |
| 4,289,201 | A | 9/1981 | Fredd | |
| 4,453,599 | A | 6/1984 | Fredd | |
| 4,469,179 | A | 9/1984 | Crow et al. | |
| 4,479,539 | A | 10/1984 | Tamplen et al. | |
| 4,545,434 | A | 10/1985 | Higgins | |
| 4,949,793 | A | 8/1990 | Rubbo et al. | |
| 4,964,460 | A | 10/1990 | Armell et al. | |
| 5,060,723 | A | 10/1991 | Sutherland et al. | |
| 6,474,411 | B1 | 11/2002 | Carrano Castro | |
| 7,086,471 | B2 | 8/2006 | Cantin et al. | |
| 8,381,823 | B2 * | 2/2013 | Swietlik | E21B 17/02 166/242.6 |
| 9,010,432 | B2 * | 4/2015 | Edwards | E21B 23/04 166/338 |
| 2009/0314492 | A1 | 12/2009 | Reid et al. | |
| 2010/0206583 | A1 | 8/2010 | Swietlik et al. | |

OTHER PUBLICATIONS

PCT International Preliminary Report on Patentability, PCT/US2012/059041, dated Apr. 16, 2015, 9 pages.

* cited by examiner

SEALING A DOWNHOLE TOOL

This application is a 371 U.S. National Phase of and claims the benefit of priority to International Patent Application Serial No. PCT/US2012/059041, filed on Oct. 5, 2012 and entitled "Sealing a Downhole Tool", the contents of which are hereby incorporated by reference.

TECHNICAL BACKGROUND

This disclosure relates to protecting a sealing surface on a well tool and, more particularly, to covering a sealing surface that seals a region between a well tool and a tubular.

BACKGROUND

Often, downhole tools deployed in a wellbore use seals or a seal stack to create a seal in a region between two or more tools or tubulars. For example, well plugs deployed on wireline or even coiled tubing, where appropriate, include a seal stack that is exposed to the wellbore during a trip into (and out of) the borehole. During the trip time, heat may cause the seals in the seal stack to soften such that thermal expansion occurs, which may cause distortion of the seals. Furthermore, the seal may be damaged mechanically as the well plug passes through restrictions or drags along the inner diameter of the wellbore during deployment. Development of subterranean zones that are significantly deep may expose the seals to temperatures greater than 450° F. for extended periods of time. After such exposure, installation of the seal into a tubular, such as a seal bore of a landing nipple, is often accomplished with mechanical jars or other uncontrollable or semi-controllable operations. Such operations to install the seal into the seal bore may be inhibited if sufficient deformation to the seal has occurred or may cause further damage to the seal resulting in a failure to establish seal integrity.

DETAILED DESCRIPTION

Figure 1:
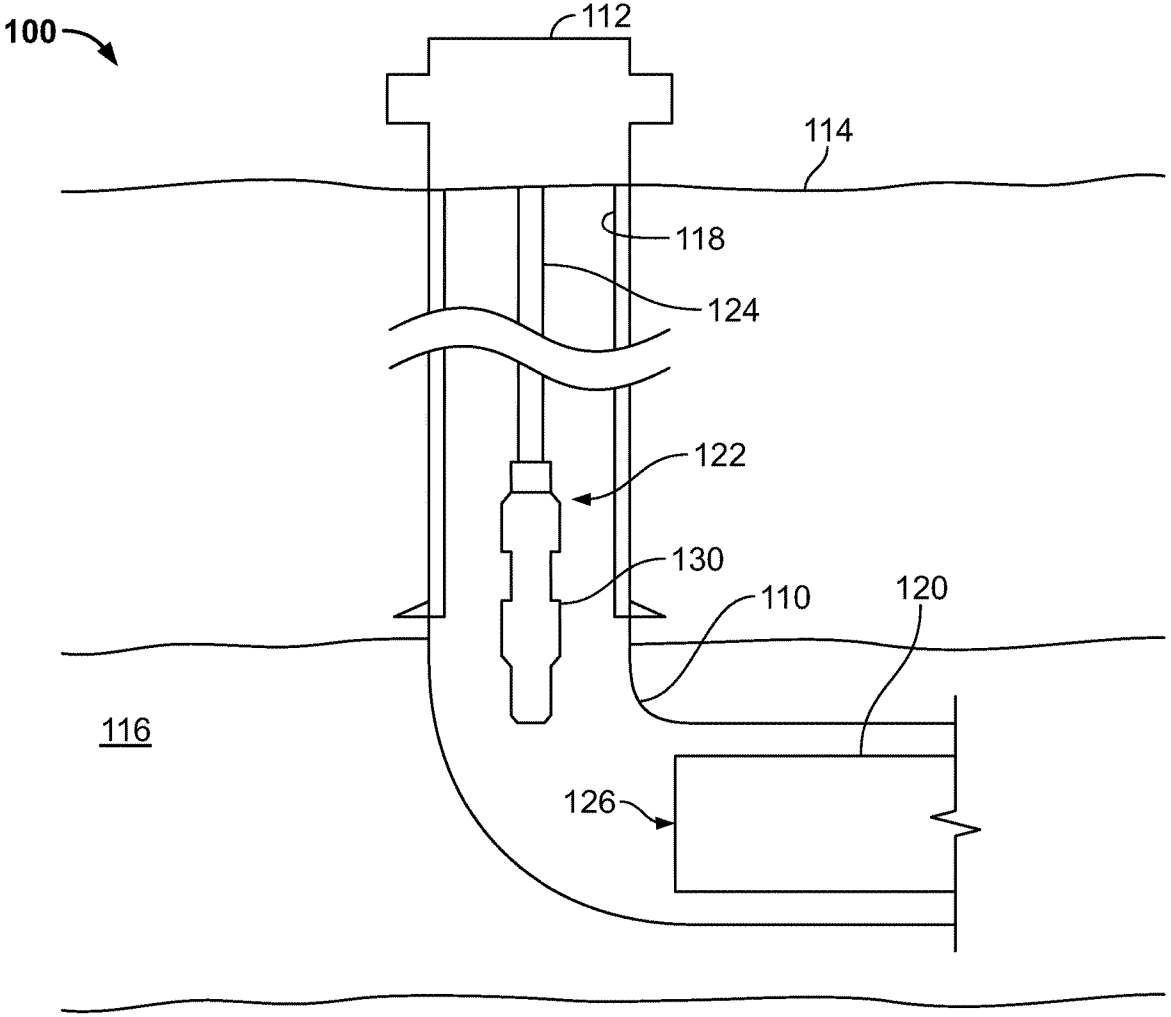
FIG. 1 is a schematic view of an example well system with a well tool that includes a coverable seal.

The present disclosure describes implementations of a well tool that includes a sleeve that moveably covers one or more seals of a seal stack. In one general implementation, a method of sealing an annulus between a well tool and a tubular includes moving the well tool through a wellbore in a run-in position, the well tool comprising a seal carried on a mandrel and a sleeve carried on the mandrel, and covering, in the run-in position, an exterior surface of the seal opposite an interior surface of the seal that faces the mandrel; landing the well tool in a tubular that comprises a shoulder on an inner surface of the tubular and a seal bore on the inner surface of the tubular, the sleeve adjacent the shoulder upon landing the well tool; and receiving a force that moves a portion of the well tool further downhole to expose at least a part of the seal to the inner surface of the tubular to create a seal between an exterior surface of the well tool and the inner surface of the tubular.

In a first aspect combinable with the general implementation, receiving a force that moves a portion of the well tool further downhole comprises receiving a force that shears a pin that couples the sleeve to the mandrel; receiving a force that urges a dog carried on the mandrel into an undercut on the inner surface of the tubular, the sleeve at a substantially fixed position between the dog and the shoulder.

A second aspect combinable with any of the previous aspects includes receiving a force that urges the seal from under the sleeve that is at the substantially fixed position.

A third aspect combinable with any of the previous aspects includes substantially preventing movement of the mandrel in an uphole direction when in the landed position with a slip positioned against the mandrel, the slip comprising a gripping edge directed downhole.

A fourth aspect combinable with any of the previous aspects includes receiving a force applied to the mandrel in an uphole direction; in response to the force, decoupling the sleeve from the mandrel; and moving the well tool in the uphole direction subsequent to decoupling the sleeve from the mandrel.

In a fifth aspect combinable with any of the previous aspects, decoupling the sleeve from the mandrel comprises receiving a force that shears a shear pin that couples the sleeve to the slip.

A sixth aspect combinable with any of the previous aspects includes raising the mandrel in the uphole direction while the sleeve remains abutting the shoulder; aligning the dog with a profile on the mandrel, the dog retracted from the undercut when aligned with the profile on the mandrel; and based on the dog retracted from the undercut, receiving a force to raise the seal so that the sleeve covers the exterior surface of the seal.

A seventh aspect combinable with any of the previous aspects includes receiving a force to move an expander sleeve that is positioned in an inner bore of the mandrel further downhole; moving a ramp of the expander sleeve under a portion of a key to urge the key radially toward the inner surface of the tubular; and locking the key into one or more undercuts on the inner surface of the tubular.

An eighth aspect combinable with any of the previous aspects includes coupling the well tool to one of a tubing or wireline.

A ninth aspect combinable with any of the previous aspects includes receiving a force that prevents a plugging dart disposed within the mandrel from moving in the uphole direction.

A tenth aspect combinable with any of the previous aspects includes moving the plugging dart in the uphole direction.

In an eleventh aspect combinable with any of the previous aspects, when substantially covered by the sleeve, the seal is adapted to withstand a temperature of about 450° F.

In another general implementation, a well tool includes a mandrel that extends through at least a portion of the well tool; a seal carried on the mandrel that comprises an interior surface that faces the mandrel and an exterior surface opposite the interior surface; and a sleeve fixed to the mandrel when the tool is in a run-in position and positioned adjacent an outer surface of the mandrel between the exterior surface of the seal and a wellbore and covering the seal, the tool changeable between a first position with the seal covered by the sleeve and a second position with at least a portion of the seal exposed from beneath the sleeve so that the exterior surface of the seal creates a seal in an annulus between the exterior surface of the well tool and an inner surface of a tubular that receives a lower end of the tool when the tool is in the second position.

A first aspect combinable with the general implementation includes a shear pin that fixes the sleeve to the mandrel when the tool is in the run-in position, the shear pin forcibly shearable to permit movement of the tool from the first position to the second position.

A second aspect combinable with any of the previous aspects includes a dog carried on the mandrel, the dog adjustable to move into an undercut on the inner surface of the tubular in response to forcible shearing of the shear pin and a force directed on the mandrel in a downhole direction, the dog abutting a shoulder of the undercut to retain the sleeve in a substantially fixed position seated on a shoulder of the inner surface of the tubular in response to the force directed on the mandrel.

In a third aspect combinable with any of the previous aspects, the tool is configured to move from the first position to the second position in response to the force directed on the mandrel in the downhole direction.

A fourth aspect combinable with any of the previous aspects includes a slip carried on the mandrel and pinned to the sleeve, the slip comprising a gripping edge directed in a downhole direction that substantially prevents movement of the mandrel in an uphole direction.

A fifth aspect combinable with any of the previous aspects includes a shear pin that couples the sleeve to the slip, the shear pin breakable to release the sleeve from the mandrel in response to a force in an uphole direction, the well tool moveable in the uphole direction subsequent to decoupling the sleeve from the mandrel.

A sixth aspect combinable with any of the previous aspects includes an expander sleeve positioned in an inner bore of the mandrel, the expander sleeve comprising a ramped outer surface.

A seventh aspect combinable with any of the previous aspects includes a key carried on the expander sleeve and moveable into a locked position into one or more undercuts of the inner surface of the tubular in response to a downhole force acting on the expander sleeve to move the ramped outer surface under the key.

In an eighth aspect combinable with any of the previous aspects, when substantially covered by the sleeve, the seal is adapted to withstand a temperature of about 450° F.

In a ninth aspect combinable with any of the previous aspects, the seal comprises a plurality of V-rings, a male adaptor, a female adapter, and a backup ring.

In another general implementation, a wellbore flow control system includes a tubular comprising a nipple and a no-go shoulder; and a flow control device that includes a mandrel; a seal carried on the mandrel, the seal comprising an inner surface that faces the mandrel and an outer surface opposite the inner surface; and a sleeve carried on the mandrel, the sleeve disposed between the seal and an inner surface of the tubular with the sleeve adjacent the no-go shoulder, the seal moveable in response to a force acting on the mandrel to expose at least a portion of the outer surface of the seal to the inner surface of the tubular.

A first aspect combinable with the general implementation includes a first shear pin that pins the sleeve to the mandrel when the flow control device is in a run-in position, the first shear pin forcibly shearable in response to the force acting on the mandrel to permit the movement of the seal.

A second aspect combinable with any of the previous aspects includes a dog carried on the mandrel, the dog adjustable to move into an undercut on the inner surface of the tubular in response to forcible shearing of the first shear pin and the force acting on the mandrel, the dog abutting a shoulder of the undercut to retain the sleeve in a substantially fixed position seated on the no-go shoulder of the inner surface of the tubular in response to the force acting on the mandrel.

A third aspect combinable with any of the previous aspects includes a second shear pin that couples the sleeve to a slip, the second shear pin breakable to release the sleeve from the mandrel in response to a force in an uphold direction, the flow control device moveable in the uphole direction subsequent to decoupling the sleeve from the mandrel.

In a fourth aspect combinable with any of the previous aspects, the sleeve abuts the no-go shoulder.

Various implementations of a well tool according to the present disclosure may include one, some, or all of the following features. For example, the well tool may include a sleeve that is configured to cover a seal. In some examples, when substantially covered by the sleeve, the seal may be adapted to withstand a temperature of about 450° F. for an extended period of time, such that sealing elements of the seal maintain a desired level of mechanical integrity during deployment of the well tool. The well tool is configured such that, when the seal is covered by the sleeve, the well tool can then be manipulated to expose the seal. In an exposed position, the seal may seal an exterior surface of the well tool and an interior surface of a seal bore within a completion tool at substantially the same time.

In some implementations, the well tool may be advanced through a wellbore while in a run-in position, such that the sleeve substantially covers the seal during the trip into the wellbore. In some examples, following such a trip, the seal can subsequently be exposed from underneath the sleeve, such that the seal may substantially seal a region between the well tool and a seal bore of a completion tool. In some implementations, the deployed well tool may be removed from the wellbore, such that the sleeve substantially covers the seal during the trip out of the wellbore. For example, the seal may be moved back underneath the sleeve, such that the seal may be protected from mechanical wear while the well tool is removed from the wellbore.

In some implementations, the well tool includes a slip assembly that includes a slip and shear pins. The slip is carried on a mandrel of the well tool and may include a serrated edge that is directed in a downhole direction, such that the slip can substantially prevent undesired movement of the mandrel in an uphole direction. In some implementations, the shear pins are breakable (e.g., shearable) at first shear points to permit downhole movement of the mandrel and accordingly, downhole movement of the seal that is carried on the mandrel. In some examples, the shear pins are further breakable (e.g., shearable) at second shear points to release the sleeve from the mandrel in response to an uphole-directed force, such that the well tool can be removed from the wellbore.

In some implementations, the well tool includes a dog that can fix the well tool to the tubular that provides the seal bore prior to the seal being exposed from underneath the sleeve. The dog, in combination with the slip, can prevent undesired movement of the well tool in the uphole direction, while allowing the well tool and the seal carried on the well tool to move in the downhole direction and installed into the seal bore.

FIG. 1 shows an example well system 100 constructed in accordance with the concepts described herein. The well system 100 includes a substantially cylindrical wellbore 110 that extends from a wellhead 112 at a terranean surface 114, downward into the Earth, into one or more subterranean zones 116. The depicted wellbore 110 is a non-vertical deviating wellbore and particularly a horizontal wellbore, having a substantially vertical portion that extends from the surface 114 to the subterranean zone 116 and a substantially horizontal portion in the subterranean zone 116. Although discussed herein in connection with a horizontally deviated wellbore 110, the concepts herein are applicable to other configurations of wellbores 110. Some examples include vertical, multilaterals, wellbores that deviate to a slant, wellbores that undulate, and/or other configurations.

A portion of the illustrated wellbore 110 extending from the wellhead 112 to the subterranean zone 116 is lined with lengths of tubing called casing 118. In constructing the well system 100, the wellbore 110 is drilled in sections. When a section is drilled, a length of the casing 118 is installed in the section. Then, the next section of the wellbore 110 is drilled and another section of the casing 118 is installed in the newly drilled section. Sections of the wellbore 110 are drilled and cased in sections until the wellbore 110 and casing 118 reach the subterranean zone 116. Then, the horizontal portion of the wellbore 110 is drilled, substantially continuously, to the termination point of the wellbore 110. In certain instances, the horizontal or deviated portion of the wellbore 110 can be 1 mile (1.6 km) long, 1.5 miles (2.4 km) long, 2 miles (3.2 km) long, or longer. Alternatively, all or a portion of the wellbore 110 may be uncased (e.g., an open hole completion).

Upon completion of the wellbore 110, a tubular 120 is run into the wellbore 110 to a specified final depth, where the tubular 120 will remain after commissioning and during operation of the well system 100 in producing the subterranean zone 116. In certain instances, the specified depth is the toe of the wellbore 110 (i.e., the tubular 120 is run until its end is at the toe of the wellbore 110). Then, the tubular 120 is tied back to the casing 118 and/or to the wellhead 112 at the terranean surface 114 with a packer and/or liner hanger. As the tubular 120 is lowered into the horizontal portion of the wellbore 110, it contacts and bears on the bottom wall of the wellbore 110.

In some implementations, the tubular 120 may include one or more landing nipples. In some examples, a landing nipple may be a completion component that is fabricated as a short section of heavy wall tubular with a machined internal surface (e.g., a polished bore receptacle) that provides a seal area and a locking profile. In some implementations, a landing nipple may be disposed at a predetermined interval within the tubular 120 to enable installation of a flow-control device (e.g., a plug or a choke). Example types of nipples that may be used include no-go nipples, selective-landing nipples, and ported or safety-valve nipples.

In some implementations, the tubular 120 is configured to receive a well tool 130 that is adapted to control a flow of material within the tubular 120. For example, the well tool 130 may be a flow control tool, such as a plug assembly, a valve, or another flow control device. The well tool 130 is configured to seal with the interior surface of the tubular 120 and to thereby create a sealed interval along a portion (e.g., a seal bore) of an internal central bore 126 of the tubular 120.

In some implementations, the well tool 130 includes an upper sub-assembly 122 that includes a connection point for a tubing 124. In some examples, the tubing 124 is configured to couple the well tool 130 to the terranean surface 114. In alternative implementations, the tubing 124 may be a wireline conductor (e.g., a single or multiple strand wireline conductor, such as a wireline, slickline, e-line, or other wire conductor). In some implementations, the tubing 124 may be a jointed tubing and/or a coiled tubing conductor.

Figure 2A:
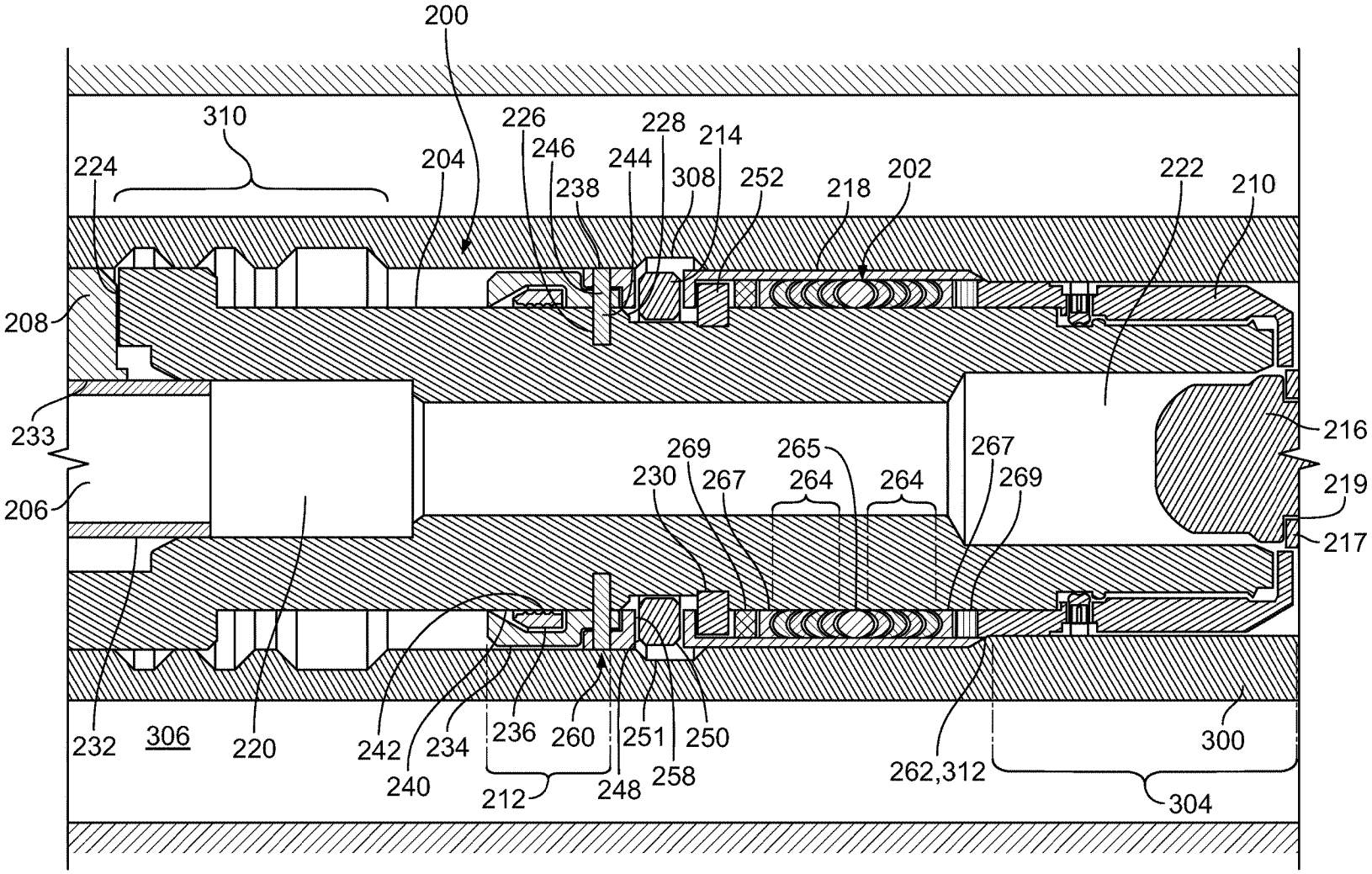
FIG. 2A is a schematic cross-sectional view of an example well tool that includes a coverable seal in a run-in position.
Figure 2B:
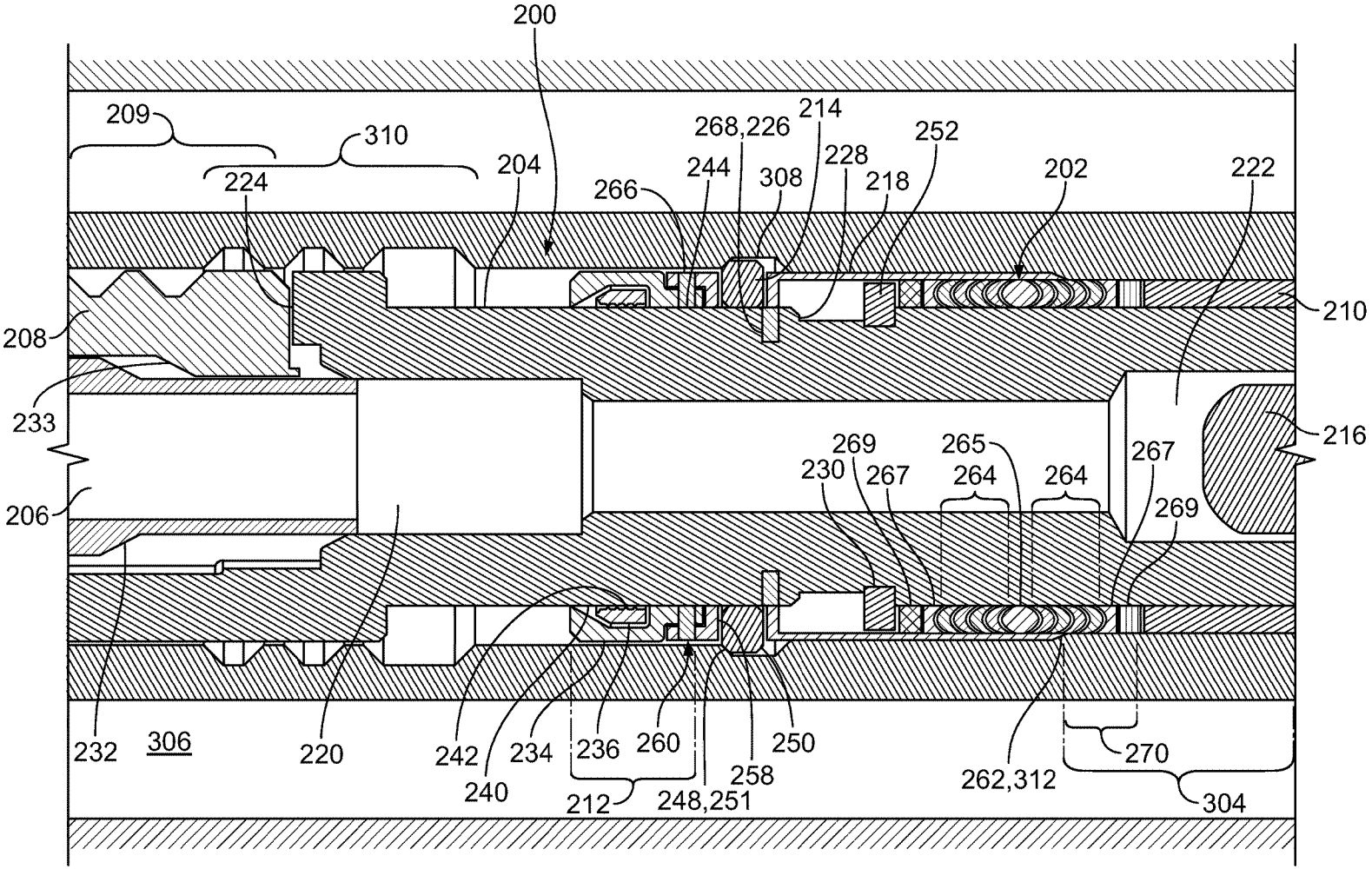
FIG. 2B is a schematic cross-sectional view of the example well tool that includes a coverable seal in a seated and partially actuated position.
Figure 2C:
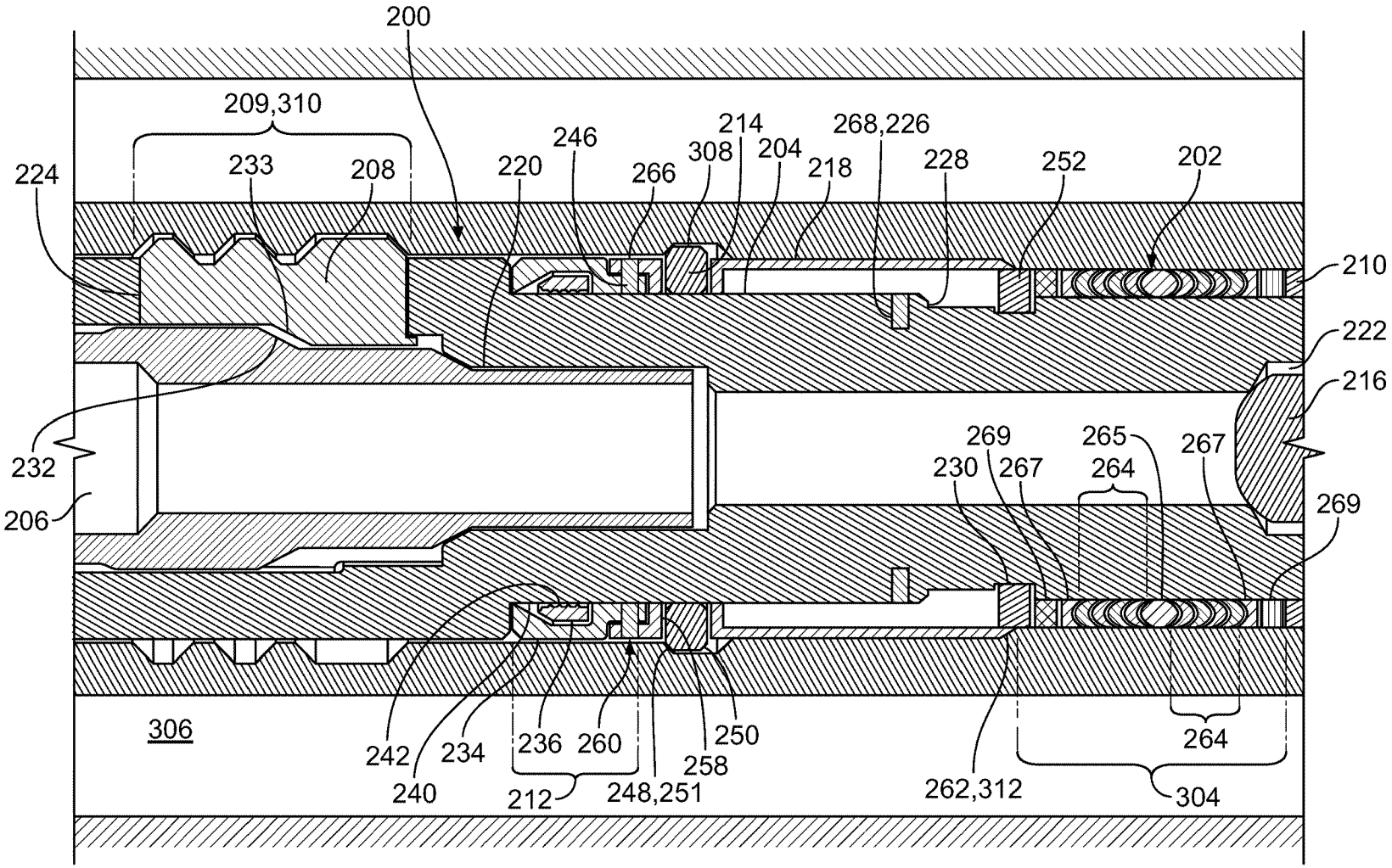
FIG. 2C is a schematic cross-sectional view of the example well tool that includes a coverable seal in an actuated position.

FIGS. 2A-2C illustrate schematic cross-sectional views of an example well tool 200 that includes a coverable seal stack 202 (e.g., one or more seals) in multiple positions. For example, FIG. 2A shows the well tool 200 in a run-in position, FIG. 2B shows the well tool 200 in a partially actuated position, and FIG. 2C shows the well tool 200 in an actuated position. In some examples, the well tool 200 may provide an implementation of the well tool 130 of FIG. 1.

With reference to FIGS. 2A-2C, the well tool 200 includes an upper assembly (e.g., an upper assembly such as the upper assembly 122 of FIG. 1), a mandrel 204, an expander sleeve 206, three keys 208, a cap 210, an annular slip assembly 212, dogs 214 (two dogs 214 are shown in FIGS. 2A-2C), a split ring 252, a sleeve 218 that is configured to cover the seal stack 202, a plugging dart 216, and a lower assembly 217 (only shown in FIG. 2A) that is coupled to the cap 210 and the plugging dart 216. In some implementations, the upper assembly includes a connection mechanism for coupling the well tool 200 to a tubing (e.g., the tubing 124 of FIG. 1).

The mandrel 204 includes an uphole bore 220 sized to allow passage of the expander sleeve 206 and a downhole bore 222 sized to receive the plugging dart 216. The mandrel 204 further includes cutouts 224 that surround lateral edges of the respective keys 208, pin bores 226 (two pin bores 226 are shown in FIGS. 2A-2C) that receive respective shear pins 238, an outer shoulder 228 against which the dogs 214 may sit, and a recess 230 that maintains a position of the split ring 252 and the seal stack 202 with respect to the mandrel 204.

The expander sleeve 206 has a ramped outer surface 232 and may be forcibly moved in a downhole direction through the uphole bore 220 of the mandrel 204 and along ramped inner surfaces 233 of the keys 208 in the downhole direction, as will be discussed in more detail below. Each key 208 includes a profile 209 that is exposed through the respective cutout 224 in the mandrel 204. The keys 208 are carried on the expander sleeve 206 and are exposed through the cutouts 224. In some implementations, the keys 208 are spaced substantially equally (e.g., about 120° apart from one another) about a circumference of the mandrel 204. In some examples, the keys 208 may be spaced unequally about the circumference of the mandrel 204.

The slip assembly 212 includes an annular slip housing 234, an annular slip 236, and the shear pins 238. The slip housing 234 is carried on the mandrel 204 and defines a pocket 240 with an outer surface of the mandrel 204. The slip 236 has a serrated edge 242 directed in a downhole direction and is carried on (in some instances pinned to) the mandrel 204 within the pocket 240. In some implementations, the serrated edge 242 of the slip 236 can substantially prevent movement of the mandrel 204 in an uphole direction. The shear pins 238 extend from an outer surface and through an uphole end of the sleeve 218 and through a downhole end of the slip housing 234, thereby coupling the slip housing 234 to the sleeve 218. When the well tool 200 is in the run-in position (as shown in FIG. 2A), the shear pins 238 further extend into the respective pin bores 226 of the mandrel 204, thereby coupling (e.g., pinning) the sleeve 218 to the mandrel 204.

In some implementations, the shear pins 238 are breakable (e.g., shearable) at first shear points 244 to permit downhole movement of the mandrel 204 and accordingly, downhole movement of the seal stack 202 that is carried on the mandrel 204. In some examples, the shear pins 238 are further breakable (e.g., shearable) at second shear points 246 to release the sleeve 202 from the mandrel 204 in response to an uphole-directed force, as will be discussed in more detail below. In some implementations, the shear pins 238 and the pin bores 226 are spaced substantially equally about the circumference of the mandrel 204. In some examples, the shear pins 238 and the pin bores 226 may be spaced unequally about the circumference of the mandrel 204.

Each dog 214 includes an uphole shoulder 248 and a downhole shoulder 250 and is exposed through the sleeve 218. The dogs 214 are carried on the mandrel 204 and may seat against the outer shoulder 228 of the mandrel 204 when the well tool 200 is in the run-in position (as shown in FIG. 2A). In some implementations, the dogs 214 are spaced substantially equally about the circumference of the mandrel 204. In some examples, the dogs 214 may be spaced unequally about the circumference of the mandrel 204.

The split ring 252 (e.g., a C-shaped ring) is carried on the mandrel 204 and is disposed uphole of the seal stack 202. The split ring 252 seats within the recess 230 of the mandrel 204 at one end and thus may substantially prevent the seal stack 202 from moving in the uphole direction relative to the mandrel 204. At an opposite end of the split ring 252, the split ring 252 is in contact with an inner surface of the sleeve 218.

The sleeve 218 includes through-channels 258 (two through-channels 258 are shown in FIGS. 2A-2C), openings 260, and a shoulder 262 disposed at a downhole end of the sleeve 218. The through-channels 258 extend inward from the outer surface of the sleeve 218 and surround lateral edges of the respective dogs 214. The openings 260 surround edges of the respective shear pins 238. In some implementations, the shoulder 262 of the sleeve 218 is configured to prevent downhole movement of the well tool 200, as will be discussed in more detail below. In some implementations, such as when the well tool 200 is in the run-in position as shown in FIG. 2, the slip housing 236 is disposed adjacent uphole edges of the through-channels 258, and the sleeve 218 extends in the downhole direction from the slip assembly 212 such that the split ring 252 and the seal stack 202 are covered by the sleeve 218.

In some implementations, the through-channels 258 are spaced substantially equally about the circumference of the mandrel 204 in order to align with the respective dogs 214. In some examples, the through-channels 258 may be spaced unequally about the circumference of the mandrel 204, depending on the spacing of the dogs 214.

In some implementations, the seal stack 202 includes two sets of seals 264 (e.g., V-ring seals), a male adapter 265 (e.g., a double-male adapter) disposed between the two sets of seals 264, two female adapters 267 that flank the outermost seals 264, and two backup rings 269 that flank the female adapters 267. In some examples, any of the male adapter 265, the female adapters 267, and the backup rings 269 may be sealing elements or non-sealing elements. In some examples, the seals 264 may be made of one or more materials, including polymer such as polyether ether keytone (PEEK), polytetrafluoroethylene (e.g., Teflon) and/or another polymer, and flexible graphite (e.g., GRAFOIL). In some instances, any of the male adapter, the female adapters 267, and the backup rings 269 may be made of one or more materials including metallic materials or polymers, such as, for example, PEEK, Teflon, nitrile, FKM (Viton), or other materials.

In some implementations, when substantially covered by the sleeve 218, the seal stack 202 may be adapted to withstand a temperature of about 450° F. for an extended period of time, such that the seals 264 maintain a specified level of mechanical integrity during deployment of the well tool 200. For instance, in some implementations, the specified level of mechanical integrity may be selected based on the integrity needed to form a seal in operation of the tool 200.

The cap 210 is carried on a downhole portion of the mandrel 204. The lower assembly 217 (shown in FIG. 2A) extends from the cap 216 in the downhole direction and includes a central bore 219 (shown in FIG. 2A) that is sized to allow passage of the plugging dart 216. In some examples, the lower assembly 217 includes a spring that is disposed within the central bore 219 of the lower assembly and that exerts an uphole-directed force against a downhole end of the plugging dart 216. In some implementations, the plugging dart 216 can act as a poppet valve and thus may allow fluid to bypass through the well tool 200 during setting of the well tool 200 in the completion tool 300 or may allow pumping through the well tool 200 after the well tool 200 is set in the completion tool 300.

FIG. 2A illustrates the well tool 200 in the run-in position and upon initial landing of the well tool 200 within the completion tool 300 and within a seal bore 304 of the completion tool 300 that is disposed within a wellbore 306. In some examples, the completion tool 300 may be an implementation of the tubular 120 of FIG. 1. The seal bore 304 is sized to allow passage of the well tool 200. The completion tool 300 includes a central undercut 308 that is configured to engage the dogs 214 during landing of the well tool 200 (see FIGS. 2B and 2C). The completion tool 300 further includes a set of uphole undercuts 310 that are configured to engage the profile 209 of the keys 208 once the well tool 200 has been fully seated within the completion tool 300 (see FIG. 2C). In the example of FIGS. 2A-2C, the undercuts 308, 310 extend about substantially an entire circumference of the seal bore 304. However, in some examples, a completion tool may include undercuts that extend along less than an entire circumference of a seal bore. The seal bore 304 defines a no-go shoulder 312 (e.g., a reduced-diameter transition region) that prevents downhole movement of the well tool 200 upon abutment of the shoulder 262 of the sleeve 218 with the no-go shoulder 312.

Still referring to FIG. 2A, upon initial landing of the well tool 200 within the completion tool 300 and with the well tool 200 in the run-in position, the seal stack 202 is substantially covered by the sleeve 218, such that the seal stack 202 may be protected from mechanical abrasions and thermal wear (e.g., melting). Additionally, the dogs 214 are seated against the outer shoulder 228 of the mandrel 204, and the shear pins 238 extend into the respective pin bores 226 of the mandrel 204. The keys 208 are positioned substantially uphole of the set of uphole undercuts 310, the expander sleeve 206 is spaced apart (i.e., uphole) from a downhole end of the uphole bore 220 of the mandrel 204, and an uphole end of the plugging dart 216 is disposed partially within the downhole bore 222 of the mandrel 204.

FIG. 2B is a schematic cross-sectional view of the example well tool 200 that includes the coverable seal stack 202 in a seated and partially actuated position. In the seated and partially actuated position, a downhole portion 270 of the seal stack 202 is in sealing contact with a portion of the inner surface of the seal bore 304. Compared to the position of the mandrel 204 as shown in FIG. 2A, the mandrel 204 as shown in FIG. 2B is positioned further downhole within the seal bore 304. Compared to the position of the plugging dart 216 as shown in FIG. 2A, the plugging dart 216 is disposed further in the uphole direction within the downhole bore 222 of the mandrel 204.

As the mandrel 204 is moved in the downhole direction, the shear pins 238 break (e.g., shear) at the first shear points 244 into uphole pin portions 266 that remain coupled to the slip housing 234 and the sleeve 218 and into downhole pin portions 268 that remain within the respective pin bores 226 of the mandrel 204. Additionally, the downhole portion 270 of the seal stack 202 carried on the mandrel 204 is moved in the downhole direction such that the sleeve 218 no longer covers the downhole portion 270 of the seal stack 202. Accordingly, the downhole portion 270 of the seal stack 202 becomes exposed and can achieve direct contact with the inner surface of the seal bore 304.

Still referring to FIG. 2B, as the mandrel 204 moves in the downhole direction, the outer surface of the mandrel 204 pops the dogs 214 radially outward such that the shoulders 248 of the dogs 214 are disposed within a shoulder 251 of the central undercut 308 of the completion tool 300. The uphole shoulders 248 of the dogs 214 abut the shoulder 251 of the central undercut 308, thus preventing the sleeve 218 and the slip assembly 212 from moving further in the uphole direction within the seal bore 304. The serrated edge 242 of the slip 236 substantially prevents the mandrel 204 from moving in the uphole direction.

FIG. 2C is a schematic cross-sectional view of the example well tool 200 that includes the coverable seal stack 202 in an actuated position. In the actuated position, the seal stack 202 is in sealing contact with the inner surface of the seal bore 304. Compared to the position of the expander sleeve 206 as shown in FIGS. 2A and 2B, the expander sleeve 206 is positioned further in the downhole direction and seated substantially fully within the uphole bore 220 of the mandrel 204.

As the expander sleeve 206 is moved in the downhole direction, the ramped outer surface 232 of the expander sleeve 206 engages the ramped inner surface 233 of the keys 208, thereby causing the keys 208 to move in the downhole direction until the profile 209 of the keys 208 seat within the set of uphole undercuts 310 of the seal bore 304. Accordingly, the keys 208 cause the mandrel 204 to move further in the downhole direction until the keys 208 are substantially locked into position along the set of uphole undercuts 310, thereby preventing the mandrel 204 from moving substantially any further in the downhole direction within the seal bore 304. In the actuated position of the well tool 200, the plugging dart 216 is seated substantially fully within the downhole bore 222 of the mandrel 204.

Additionally, the split ring 252 and the seal stack 202 carried on the mandrel 204 are moved sufficiently in the downhole direction such that the sleeve 218 no longer covers the seal stack 202. Accordingly, the seal stack 202 is exposed and can achieve direct contact with the inner surface of the seal bore 304. In some examples, all or a portion of the split ring 252 may additionally become exposed and achieve direct contact with the inner surface of the seal bore 304. Thus, the well tool 200 is configured such that the sleeve 218 can cover the seal stack 202 and such that the well tool 200 can then be manipulated to expose the seal stack 202. In an exposed position, the seal stack 202 may seal an exterior surface of the well tool 200 and an interior surface of the seal bore 304 at substantially the same time.

In operation, the well tool 200 may be advanced through the wellbore 306 while in the run-in position, such that the sleeve 218 substantially covers the seal stack 202 during the trip into the wellbore 306 (e.g., to protect the seal stack 202 from heat, pressure, abrasion, and other deformative conditions). Accordingly, the seal stack 202 may be substantially protected from mechanical and thermal wear during the trip and therefore may subsequently substantially seal a region between the well tool 200 and the seal bore 304 of the completion tool 300.

Referring particularly to FIG. 2A, the upper assembly of the well tool 200 may be coupled to a tubing (e.g., the tubing 124 of FIG. 1) and run downhole into the wellbore 306 using a running tool (not shown). The running tool further applies a downhole-directed force on the plugging dart 216. Example running tools adapted to advance the well tool 200 may include mechanical running tools, hydraulic running tools, and electronic running tools, as will be known to those skilled in the art. When the well tool 200 is in the run-in position, the sleeve 218 of the well tool 200 substantially covers an external surface of the seal stack 202, such that the seal stack 202 is substantially protected from wear during the trip. The well tool 200 is run in the downhole direction through the wellbore 306 until the shoulder 262 of the sleeve 218 abuts the no-go shoulder 312 of the seal bore 304 within the completion tool 300. The downhole-directed force exerted on the plugging dart 216 maintains the plugging dart 216 in the position shown in FIG. 2A such that the plugging dart 216 resists the uphole-directed force exerted by the spring within the central bore 219 of the lower assembly 217.

Referring particularly to FIG. 2B, in some implementations, the downhole-directed force acting on the plugging dart 216 may be removed. As such force is removed, the plugging dart 216 can advance in the uphole direction within the downhole bore 222 of the mandrel 204 in response to the uphole-directed force exerted on the plugging dart 216 by the spring (not shown) within the central bore 219 (shown in FIG. 2A) of the lower assembly 217 (shown in FIG. 2A).

The running tool may then be used to apply a downhole-directed force to the mandrel 204 of the well tool 200, causing the mandrel 204 to shear the shear pins 238 at the first shear points 244 and causing the outer shoulder 228 of the mandrel 204 to urge (e.g., pop) the dogs 214 into the central undercut 308 of the seal bore 304. The shearing of the shear pins 238 decouples the sleeve 218 from the mandrel 204 of the well tool 200, such that the mandrel 204 moves in the downhole direction, while the dogs 214, with the shoulders 248 of the dogs 214 positioned within the shoulder 251 of the central undercut 308 of the completion tool 300, maintain a position of the sleeve 218 and the slip housing 234.

As the mandrel 204 is moved in the downhole direction, the downhole portion 270 of the seal stack 202 is urged from underneath the sleeve 218 and becomes exposed. In this manner, the downhole portion 270 of the seal stack 202 can achieve contact with the inner surface of the seal bore 304, such that the seal stack 202 may be partially actuated within the seal bore 304.

Referring particularly to FIG. 2C, in some implementations, the running tool may then be used to apply a downhole-directed force to the expander sleeve 206 of the well tool 200. As the expander sleeve 206 is forced in the downhole direction, the ramped outer surface 232 of the expander sleeve 206 engages the ramped inner surface 233 of the keys 208, thereby causing the keys 208 to move radially outward until the profile 209 of the keys 208 seat within the set of uphole undercuts 310 of the completion tool 300. Accordingly, the keys 208 are substantially locked into position along the set of uphole undercuts 310 and the expander sleeve 206 is seated substantially within the uphole bore 220 of the mandrel 204. In this manner, the mandrel 204 is prevented from moving substantially any further in the downhole direction within the seal bore 304.

The plugging dart 216 advances in the uphole direction within the downhole bore 222 of the mandrel 204 in response to the uphole-directed force exerted on the plugging dart 216 by the spring (not shown) within the central bore 219 (shown in FIG. 2A) of the lower assembly 217 (shown in FIG. 2A). The plugging dart 216 advances in the uphole direction until the plugging dart 216 is substantially fully seated within the downhole bore 222.

Additionally, the seal stack 202 carried on the mandrel 204 is moved in the downhole direction (e.g., urged from under the sleeve 218) such that the sleeve 218 no longer covers the seal stack 202. Accordingly, the seal stack 202 becomes exposed and can achieve contact with the inner surface of the seal bore 304, such that the seal stack 202 may be actuated within the seal bore 304. In some implementations, all or a portion of the split ring 252 may additionally become exposed and achieve direct contact with the inner surface of the seal bore 304.

Still referring to FIG. 2C, in some implementations, following deployment of the well tool 200 in the seal bore 304, the well tool 200 may be removed from the completion tool 300. Accordingly, an uphole-directed force may be applied to the mandrel 204 (e.g., through a running tool). In some examples, the sleeve 218 is initially maintained in position (i.e., where the shoulder 262 of the sleeve 218 abuts the no-go shoulder 312 of the seal bore 304) by the shoulders 248, 250 of the dogs 214 that are disposed within the central undercut 308 of the completion tool 300 while the mandrel 204 experiences the uphole-directed force.

Once the uphole-directed force on the mandrel 204 becomes sufficient to overcome the resistance to uphole-directed movement provided by the serrated edge 242 of the slip 236, the shear pins 238 may break (e.g., shear) at the second shear points 246. In this manner, the mandrel 204 is decoupled from the sleeve 218, allowing the mandrel 204 to move in the uphole direction from a seated position within the completion tool 300, carrying with it the slip housing 234, the slip 236, the set of rings 216, and the seal stack 202.

As the mandrel 204 moves in the uphole direction, the seal stack 302 moves back underneath the sleeve 218, and the outer shoulder 228 of the mandrel 204 moves beneath the dogs 214, allowing the dogs 214 to fall out of the central undercut 308 of the completion tool 300 and against the outer shoulder 228 of the mandrel 204. In this manner, the sleeve 218 may be permitted to move in the uphole direction once the split ring 252 abuts the downhole edge of the through-channel 258 of the sleeve 218. In such position of the mandrel 204, the seal stack 202 is substantially covered by the sleeve 218, such that the seal stack 202 may be protected from wear while the well tool 200 is lifted from the completion tool 300 and out of the wellbore 306.

In another example implementation, and referring to FIG. 2C, a second recess (similar to the recess 230) may be formed on the mandrel 204 at or near to the position of the dog 214 as shown in FIG. 2C. Thus, mandrel 204 is urged downward and the dog 214 moves into the central undercut 308, the dog 214 may also be retracted into the second recess that is opposite the central undercut 308 as shown in FIG. 2C. The dog 214 would therefore fall into the second recess immediately or soon after the well tool 200 is set. Upon retrieval, the well tool 200 could then be pulled from the well bore without having to re-cover the seal stack 202 with the sleeve. 218.

A number of variations have been described above. Nevertheless, it will be understood that still further modifications may be made. For example, in some implementations, the well tool 200 may include a different number of keys 208 and cutouts 224 than those shown in FIGS. 2A-2C. In some implementations, the well tool 200 may include a different number of shear pins 238 and pin bores 226 than those shown in FIGS. 2A-2C. In some examples, the well tool 200 may include a different number of dogs 214 and through-channels 258 than those shown in FIGS. 2A-2C. In some implementations, the well tool 200 may include collets latch (e.g., spring collets) instead of the dogs 214. Accordingly, other implementations are within the scope of the following claims.

What is claimed is:

1. A method of sealing an annulus between a well tool and a tubular, comprising:

moving the well tool through a wellbore in a run-in position, the well tool comprising a seal carried on a mandrel and a sleeve carried on the mandrel, and covering, in the run-in position, an exterior surface of the seal opposite an interior surface of the seal that faces the mandrel;

landing the well tool in the tubular that comprises a shoulder on an inner surface of the tubular and a seal bore on the inner surface of the tubular, the sleeve adjacent the shoulder upon landing the well tool; and receiving a force that moves a portion of the well tool further downhole to expose at least a part of the seal to the inner surface of the tubular to create a seal between an exterior surface of the well tool and the inner surface of the tubular, wherein the sleeve includes:

an opening configured to allow a pin there-through, the pin extendable into a pin bore of the mandrel to thereby couple the sleeve to the mandrel, and a through-channel configured to surround lateral edges of a dog carried on the mandrel, the dog engageable with an undercut of the tubular to thereby to make the well tool fixable to the tubular.

2. The method of claim 1, wherein receiving a force that moves a portion of the well tool further downhole comprises:

receiving a force that shears the pin that couples the sleeve to the mandrel; and receiving a force that urges the dog carried on the mandrel into the undercut on the inner surface of the tubular, the sleeve at a substantially fixed position between the dog and the shoulder.

3. The method of claim 2, further comprising:

receiving a force that urges the seal from under the sleeve that is at the substantially fixed position.

4. The method of claim 2, further comprising:

substantially preventing movement of the mandrel in an uphole direction when in the landed position with a slip positioned against the mandrel, the slip comprising a gripping edge directed downhole.

5. The method of claim 4, further comprising:

receiving a force applied to the mandrel in an uphole direction;

in response to the force, decoupling the sleeve from the mandrel; and moving the well tool in the uphole direction subsequent to decoupling the sleeve from the mandrel.

6. The method of claim 5, where decoupling the sleeve from the mandrel comprises receiving a force that shears the pin that couples the sleeve to the slip, the method further comprising:

raising the mandrel in the uphole direction while the sleeve remains abutting the shoulder;

aligning the dog with a profile on the mandrel, the dog retracted from the undercut when aligned with the profile on the mandrel; and based on the dog retracted from the undercut, receiving a force to raise the seal so that the sleeve covers the exterior surface of the seal.

7. The method of claim 1, further comprising:

receiving a force to move an expander sleeve that is positioned in an inner bore of the mandrel further downhole;

moving a ramp of the expander sleeve under a portion of a key to urge the key radially toward the inner surface of the tubular; and locking the key into one or more undercuts on the inner surface of the tubular.

8. The method of claim 1, further comprising coupling the well tool to one of a tubing or wireline.

9. The method of claim 1, further comprising receiving a running tool force that prevents a plugging dart disposed within the mandrel from moving in the uphole direction.

10. The method of claim 1, further comprising moving a plugging dart in the uphole direction.

11. The method of claim 1, wherein when substantially covered by the sleeve, the seal is adapted to withstand a temperature of about 450° F.

12. A well tool, comprising:

a mandrel that extends through at least a portion of the well tool;

a seal carried on the mandrel that comprises an interior surface that faces the mandrel and an exterior surface opposite the interior surface; and a sleeve fixed to the mandrel when the tool is in a run-in position and positioned adjacent an outer surface of the mandrel between the exterior surface of the seal and a wellbore and covering the seal, the tool changeable between a first position with the seal covered by the sleeve and a second position with at least a portion of the seal exposed from beneath the sleeve so that the exterior surface of the seal creates a seal in an annulus between the exterior surface of the well tool and an inner surface of a tubular that receives a lower end of the tool when the tool is in the second position wherein the sleeve includes:

an opening configured to allow a pin there-through, the pin extendable into a pin bore of the mandrel to thereby couple the sleeve to the mandrel, and a through-channel configured to surround lateral edges of a dog carried on the mandrel, the dog engageable with an undercut of the tubular to thereby to make the well tool fixable to the tubular.

13. The well tool of claim 12, wherein:

when the tool is in the run-in position, the pin is forcibly shearable to permit movement of the tool from the first position to the second position; and the dog is adjustable to move into the undercut on the inner surface of the tubular in response to forcible shearing of the pin and a force directed on the mandrel in a downhole direction, the dog abutting a shoulder of the undercut to retain the sleeve in a substantially fixed position seated on a shoulder of the inner surface of the tubular in response to the force directed on the mandrel.

14. The well tool of claim 13, where the tool is configured to move from the first position to the second position in response to the force directed on the mandrel in the downhole direction.

15. The well tool of claim 13, further comprising:

a slip carried on the mandrel and pinned to the sleeve, the slip comprising a gripping edge directed in a downhole direction that substantially prevents movement of the mandrel in an uphole direction.

16. The well tool of claim 15, further comprising:

the pin that couples the sleeve to the slip, the pin breakable to release the sleeve from the mandrel in response to a force in an uphole direction, the well tool moveable in the uphole direction subsequent to decoupling the sleeve from the mandrel.

17. The well tool of claim 12, further comprising:

an expander sleeve positioned in an inner bore of the mandrel, the expander sleeve comprising a ramped outer surface; and a key carried on the expander sleeve and moveable into a locked position into one or more undercuts of the inner surface of the tubular in response to a downhole force acting on the expander sleeve to move the ramped outer surface under the key.

18. The well tool of claim 12, wherein when substantially covered by the sleeve, the seal is adapted to withstand a temperature of about 450° F.

19. The well tool of claim 12, wherein the seal comprises a plurality of V-rings, a male adaptor, a female adapter, and a backup ring.

20. A wellbore flow control system, comprising:

a tubular comprising a nipple and a no-go shoulder; and a flow control device comprising:

a mandrel;

a seal carried on the mandrel, the seal comprising an inner surface that faces the mandrel and an outer surface opposite the inner surface; and a sleeve carried on the mandrel, the sleeve disposed between the seal and an inner surface of the tubular with the sleeve adjacent the no-go shoulder, the seal moveable in response to a force acting on the mandrel to expose at least a portion of the outer surface of the seal to the inner surface of the tubular, wherein the sleeve includes:

an opening configured to allow a pin there-through, the pin extendable into a pin bore of the mandrel to thereby couple the sleeve to the mandrel, and a through-channel configured to surround lateral edges of a dog carried on the mandrel, the dog engageable with an undercut of the tubular to thereby to make the well tool fixable to the tubular.

21. The wellbore flow control system of claim 20, further comprising:

when the flow control device is in a run-in position, the pin is forcibly shearable in response to the force acting on the mandrel to permit the movement of the seal; and a dog carried on the mandrel, the dog is adjustable to move into the undercut on the inner surface of the tubular in response to forcible shearing of the pin and the force acting on the mandrel, the dog abutting a shoulder of the undercut to retain the sleeve in a substantially fixed position seated on the no-go shoulder of the inner surface of the tubular in response to the force acting on the mandrel.

22. The wellbore flow control system of claim 21, further comprising:

a second shear pin that couples the sleeve to a slip, the second shear pin breakable to release the sleeve from the mandrel in response to a force in an uphold direction, the flow control device moveable in the uphole direction subsequent to decoupling the sleeve from the mandrel.

23. The wellbore flow control system of claim 21, wherein the sleeve abuts the no-go shoulder.

* * * * *